US006054966A

United States Patent [19]

Haapala

[11] Patent Number: 6,054,966

[45] **Date of Patent: *Apr. 25, 2000**

[54] ANTENNA OPERATING IN TWO FREQUENCY RANGES

[75] Inventor: Paivi Haapala, Espoo, Finland

[73] Assignee: Nokia Mobile Phones Limited, Espoo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/658,620

[22] Filed: Jun. 5, 1996

[30] Foreign Application Priority Data

Jun. 6, 1995 [FI] Finland ..... 952780

[51] Int. Cl.[7] ..... H01Q 1/36

[52] U.S. Cl. ..... 343/895; 343/749

[58] Field of Search ..... 343/702, 895, 343/866, 867, 722, 725, 749

[56] References Cited

U.S. PATENT DOCUMENTS

| | | | |
|---|---|---|---|
| 4,229,743 | 10/1980 | Vo et al. | 343/895 |
| 4,442,438 | 4/1984 | Siwiak et al. | 343/792 |
| 4,772,895 | 9/1988 | Garay et al. | 343/895 |
| 4,998,078 | 3/1991 | Hulkko | 333/109 |
| 5,239,304 | 8/1993 | Egashira | 343/727 |
| 5,274,388 | 12/1993 | Ishizaki et al. | 343/895 |
| 5,341,149 | 8/1994 | Valimaa et al. | 343/895 |
| 5,374,937 | 12/1994 | Tsunekawa et al. | 343/895 |
| 5,479,178 | 12/1995 | Ha | 343/702 |

FOREIGN PATENT DOCUMENTS

| | | | |
|---|---|---|---|
| 22843 | 6/1972 | Australia | H01Q 1/36 |
| 0593185 A1 | 4/1994 | European Pat. Off. . | |
| 0 650 215 A3 | 4/1995 | European Pat. Off. . | |
| 0650215 A2 | 4/1995 | European Pat. Off. . | |
| 2 030 778 | 4/1980 | United Kingdom . | |
| WO 92/16980 | 10/1992 | WIPO . | |

*Primary Examiner*—Don Wong
*Assistant Examiner*—Tho Phan
*Attorney, Agent, or Firm*—Perman & Green, LLP

[57] ABSTRACT

The invention relates to an antenna structure D with at least two resonance frequency bands. It comprises a first antenna element (P2; P3) which is preferably a straight conductor, and a second antenna element (HX3; HX4) which is preferably a conductor wound into a cylindrical coil, the antenna elements having different resonance frequencies. A rod element (P2; P3) is partly inside a helical element (HX3; HX4) and they can comprise the same feed point (A4) or separate feed points (A5; A6). The antenna can comprise a third antenna element (HX5) which is preferably a conductor wound into a cylindrical coil comprising a different resonance frequency from the other two antenna elements. The antenna according to the invention is well-adapted to be used in a mobile phone operating in at least two cellular telephone systems using different frequencies.

12 Claims, 4 Drawing Sheets

ANTENNA OPERATING IN TWO FREQUENCY RANGES

BACKGROUND OF THE INVENTION

The invention relates to an antenna structure which comprises two resonance frequency bands, i.e., which can be used as the antenna of a radio set in two frequency ranges.

Mobile phones operating in cellular networks are rapidly becoming the most important means of personal communications used to convey speech, telefax messages, and data in electric form via communications networks from one user to another. Such a mobile phone is used in the following as an example of a radio set in connection with which the antenna of the invention can be used.

Cellular telephone systems are used in different parts of the world, where operating frequency ranges deviate considerably from one another. Of digital cellular telephone systems, the operating frequencies of the GSM system (Groupe Speciale Mobile) are around 900 MHz, those of the JDC (Japanese Digital Cellular) in the ranges of 800 and 1500 MHz, those of the PCN (Personal Communication Network) in the range of 1800 MHz, and those of the PCS (Personal Communication System) in the range of 1900 MHz.

The mobile phones intended for these systems generally use simple cylindrical coil antennas, i.e., helical antennas, or rod antennas formed of straight conductors, due to their low manufacturing costs and relatively high electrical performance. The resonance frequency of the antenna is defined by its electric length, which has to form a certain part of the wavelength of the radio frequency in use. The electric length of a helical antenna used on mobile phone frequencies is preferably, e.g., $3\lambda/4$, $5\lambda/4$, or $\lambda/4$, in which $\lambda$ is the wavelength being used. Correspondingly, the electric length of a rod antenna is preferably, e.g., $\lambda/2$, $5\lambda/8$, $3\lambda/8$, or $\lambda/4$. Solutions are also known in which the rod part and the helix part can be connected alternately to the antenna port of the radio set, as well as rod-helix serial connections which can be pushed partly inside the telephone (e.g., patent publication WO 92/16980). The aim of these solutions is generally to make the antenna as small as possible when in storage and transportation position, but such that it can be pulled out when necessary for a better connection.

Since the resonance frequency of the antenna according to prior art depends on the wavelength in the manner described above, one antenna can only be used in a mobile phone intended for the cellular telephone system of one frequency range. However, in some cases it is preferable that one and the same telephone can also be used in another frequency range. In this case, a viable antenna solution is needed in addition to other appropriate RF-parts.

The easiest solution would be to provide the telephone with at least two separate antennas, of which the user could place in his telephone the one corresponding to the frequency range of the system he is using at that time. However, it is probable that the needed replacement antenna cannot be found at that time. Continuous replacing of antennas also strains the antenna plug and may cause contact disturbances in the course of time. Another alternative is to prepare at least two fixed, differently dimensioned antennas at different points of the telephone, of which, by using a switch, the user selects the one corresponding to the frequency range of the system being used. This increases the number of parts of the telephone and, consequently, the manufacturing costs.

U.S. Pat. No. 4,442,438 discloses an antenna structure which resonates on two frequencies and comprises essentially two helices HX1, HX2 and one rod element P1, according to FIG. 1. Helices HX1 and HX2 are installed sequentially in the direction of the symmetry axis of the structure and their adjacent ends A1 and A2 form the feed point of the composite structure. Rod element P1 is partly inside the upper helix HX1, extending slightly outside, and its feed point A3 is at the lower end thereof. RF signals are brought to this feed point A3 through coaxial conductor KX joining with the symmetry axis of the structure, the coaxial conductor going through the lower helix HX2 . Feed point A3 of the rod element is connected to lower end A1 of the upper helix and the lower helix is connected, at the upper end A2 thereof, to the conducting and grounded sheath of coaxial conductor KX. The first resonance frequency of the structure is the resonance frequency of the combined structure formed by helices HX1 and HX2; 827 MHz in the exemplifying embodiment. The second resonance frequency of the structure is the common resonance frequency of the upper helix HX1 and rod element P1, which is 850 MHz in the exemplifying embodiment. Helix HX1 and rod element P1 are thus dimensioned so that they comprise essentially the same resonance frequencies.

The structure disclosed in the U.S. patent is relatively complex and its physical length in the direction of the symmetry axis is the sum of the physical lengths of lower helix HX2 and rod element P1. The most troublesome point of the structure from the point of view of the manufacturing technique is the feed point arrangement in the middle of the antenna, in which lower end A3 of the rod element and lower end A1 of the upper helix have to be galvanically connected, and the lower helix has to be connected at its upper end A2 to the sheath of the coaxial conductor feeding the rod element. The difference between the two resonances obtained by using the structure is small according to the material disclosed in the patent because upper helix HX1 and rod element P1 have to be dimensioned so that they have essentially the same common resonance frequencies, therefore, it cannot be implemented in telephones operating on the GSM and PCN frequencies, for example. The descriptive part of the patent thus suggests, for the object of the invention, that the resonance frequency range of the mobile phone antenna should be widened so that it would better cover the whole frequency band in one cellular telephone system. It would be difficult to apply the structure to more than two resonance frequencies.

The object of the present invention is to provide an antenna suitable for radio communications, especially for mobile phones, comprising at least two discrete resonance frequency ranges. Another object of the invention is to disclose an antenna structure whose resonance frequencies can be freely selected when designing the antenna. A further object of the invention is to disclose a mobile phone antenna with at least two frequencies whose structure is simple and reliable and which is well-adapted to mass production. A further object of the invention is to disclose a small-size, at least dual-frequency mobile phone antenna.

SUMMARY OF THE INVENTION

The objects of the invention are achieved by an antenna structure comprising at least two discrete resonating elements. A first element, preferably a straight conductor, i.e., a rod element, can be placed partly or fully inside a second element, preferably a cylindrical coil conductor, i.e., a helical element. By adding a third antenna around the structure, preferably a cylindrical coil conductor, whose inner diameter is larger than the outer diameter of the first antenna element, a third resonance frequency is obtained.

Feeding of the resonating antenna elements can be effected from a common feed point, or all the elements can comprise their own feed points.

The antenna structure according to the invention comprising a first antenna element and a second antenna element, which is a cylindrical coil conductor, is characterized in that the said first antenna element comprises a part which is essentially inside the said cylindrical coil conductor, and the resonance frequency of the said first antenna element is essentially different than the resonance frequency of the said second antenna element.

In the course of the development work resulting in the invention it was observed that a rod antenna can be placed inside a helical antenna without the antennas disturbing each other's operation considerably, when they are dimensioned essentially on different resonance frequencies. The resonance frequency of the helical antenna, which is a part of the combined structure, is slightly lower than the resonance frequency of a discrete helical antenna of corresponding dimensions. Correspondingly, the resonance frequency of the rod antenna, which is a part of the combined structure, is slightly lower than that of a discrete rod antenna of corresponding dimensions. By dimensioning the parts of the antenna structure in the manner described below, the resonance frequencies can be adapted so that the combined structure has its first resonance frequency range preferably in the operating frequency range of some cellular mobile phone system, a second resonance frequency range preferably in the operating frequency range of another cellular mobile phone system, and possibly, a third resonance frequency in the operating frequency range of a third cellular mobile phone system.

BRIEF DESCRIPTION OF THE DRAWINGS

The invention is described in the following in more detail with the aid of its embodiments and with reference to the appended figures in which.

DETAILED DESCRIPTION OF THE PREFERRED EMBODIMENTS

Figure 1:
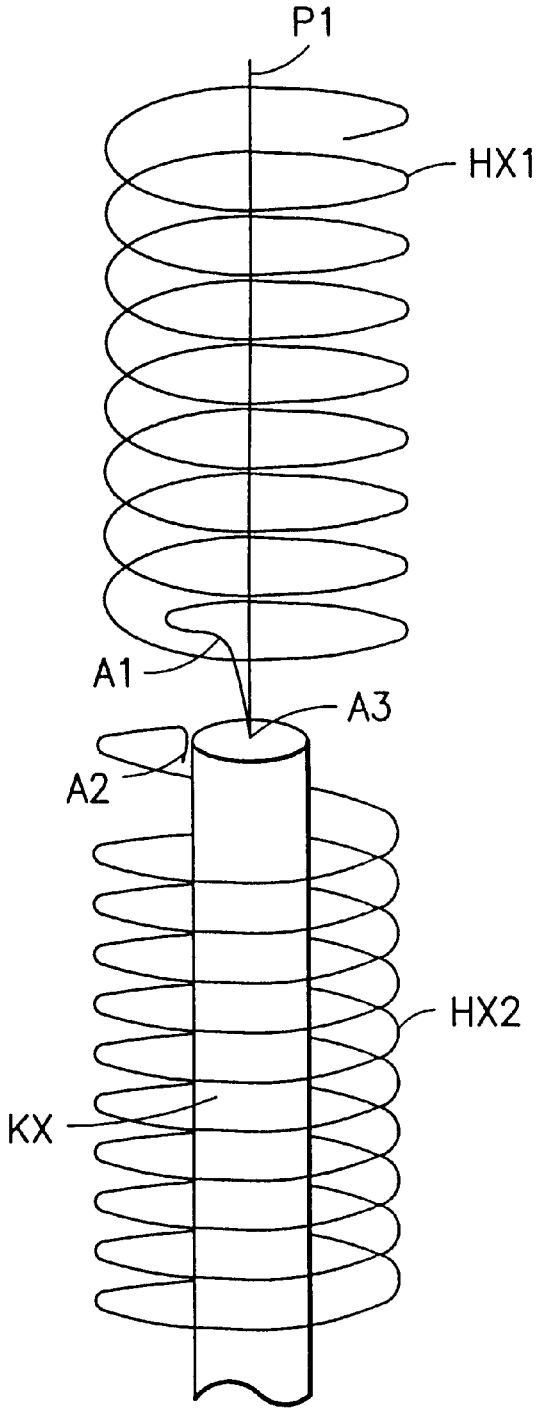
FIG. 1 PRIOR ART
FIG. 1 presents schematically a known antenna structure with two resonance frequencies.

Reference has been made above to FIG. 1 in connection with the description of prior art, so the invention is described in the following mainly with reference to FIGS. 2–6.

Figure 2:
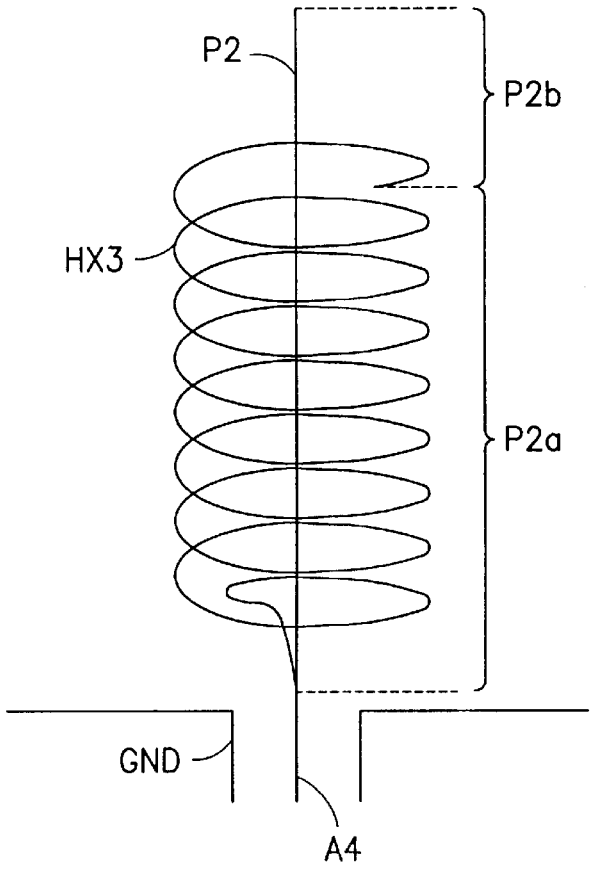
FIG. 2 presents schematically an antenna structure according to the invention.

FIG. 2 presents an antenna structure comprising helical element HX3 and rod element P2 which are manufactured of conducting material and connected at their lower ends, with respect to the operating position presented in the figure, to common feed point A4. The electrical length of helical element HX3 corresponds to a fraction of the wavelength of an operating frequency of the structure in a manner known per se, and its physical length in the direction of the symmetry axis, i.e., the longitudinal axis of the structure mainly depends on how closely it is wound, i.e., what the pitch of the helix is. The electrical length of rod element P2, which is essentially the same as its physical length, corresponds, in a manner known per se, a fraction of the wavelength of another operating frequency of the structure, and is preferably higher than the length of helical element HX3 in the direction of the symmetry axis, whereby it extends partly outside helical element HX3 at the upper end thereof with respect to the operating position. This is not necessary as such because calculations have proven that a rod element which is fully inside a helical element functions satisfactorily as an antenna; an embodiment of the invention is otherwise similar to the one in FIG. 2, except rod element P2 only comprises part P2*a* inside the helix. Ground plane GND made of conducting material envelopes feed point A4.

The operation of the antenna structure was analyzed by simulation software, therefore, a computer model was made of it. In the model, the rod element P2 is a straight conductor and helical element HX3 consists of interconnected, sequential straight conductor parts, 16 per each turn of the helix. S-parameter $S_{11}$ calculated in one simulation of the antenna according to the invention, depicting the RF power reflected from the antenna port back to the circuit feeding it, is presented graphically in FIG. 3 as a function of frequency. According to the dimensioning examples used in this simulation, the resonance frequency of rod element P2 functioning as a part of the antenna structure is 1.9 GHz, and its input impedance is slightly less than 50 Ω. The voltage standing-wave ratio (VSWR) counted for it is better than 2:1 and reflection losses are less than −10 dB on a frequency band whose width is 16% of the nominal frequency.

Correspondingly, according to calculations made with the same measurement values, helical element HX3 comprises, as part of the combined antenna structure, a resonance frequency of 910 MHz. Its input impedance is fairly low, so a ratio of 8:1 is obtained in calculations as the voltage standing-wave ratio. A bandwidth of half the power, i.e., 3 dB, is about 13%. The reflection losses of helical element HX3 are considerably higher than those of rod element P2 but losses can be reduced when necessary and the input impedance increased by using matching circuits (not shown in the figure) which comprise RF-technique known per se by those skilled in the art.

Figure 7:
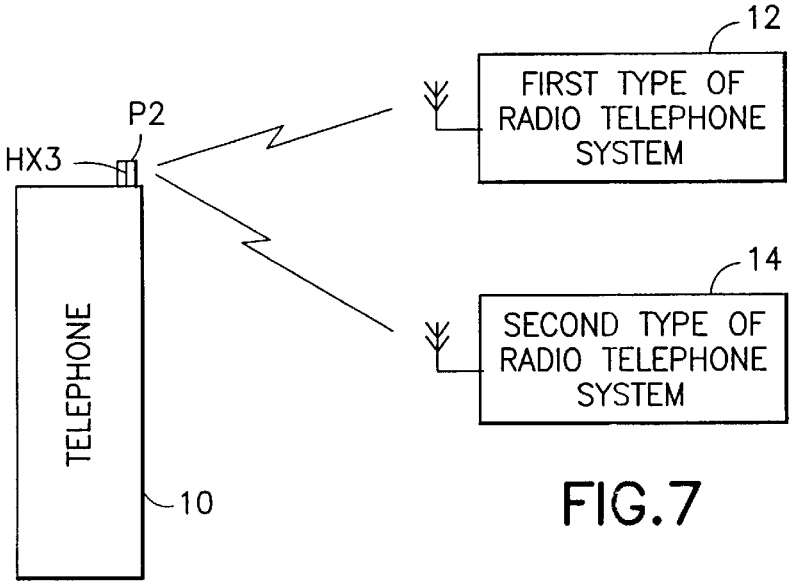
FIG. 7 is a schematic view of a telephone with the antenna of FIG. 2 showing communication with two different types of radio telephone systems.

Referring also to FIG. 7, a radio telephone having the antenna assembly of FIG. 2 is shown. As noted above, the antenna assembly is suitable for radio communications comprising at least two discrete resonance frequency ranges. This allows the telephone to be used with two different types of radio telephone systems having differ operating frequency ranges, such as GSM, JDC, PCN or PCS as noted above. FIG. 7 illustrates communication by the telephone 10 (having antenna assembly P2, Hx3) with a first type of radio telephone system 12 having a first operating frequency range and a different second type of radio telephone system 14 having a second different operating frequency range.

Calculatory analyses have also been used to study the effect of antenna elements HX3, P2 on each other's radiation patterns. Calculations indicate that radiation patterns do not change considerably with respect to the radiation patterns of discrete antennas. The presence of rod element P2 perhaps slightly decreases the radiation pattern of helical element HX3 in the opposite direction to feed point A4, but not considerably. No significant alteration can be perceived in the radiation pattern of rod element P2.

Figure 4:
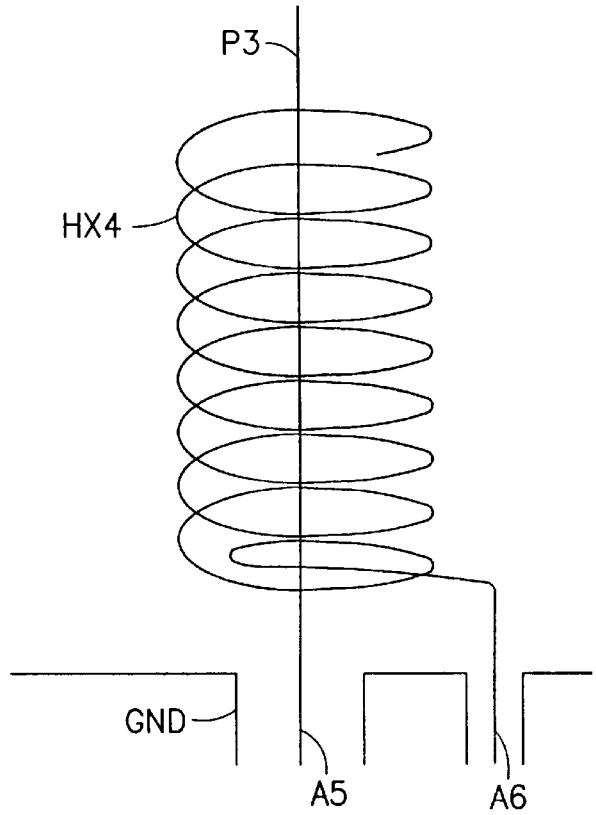
FIG. 4 presents schematically another antenna structure according to the invention.
Figure 3:
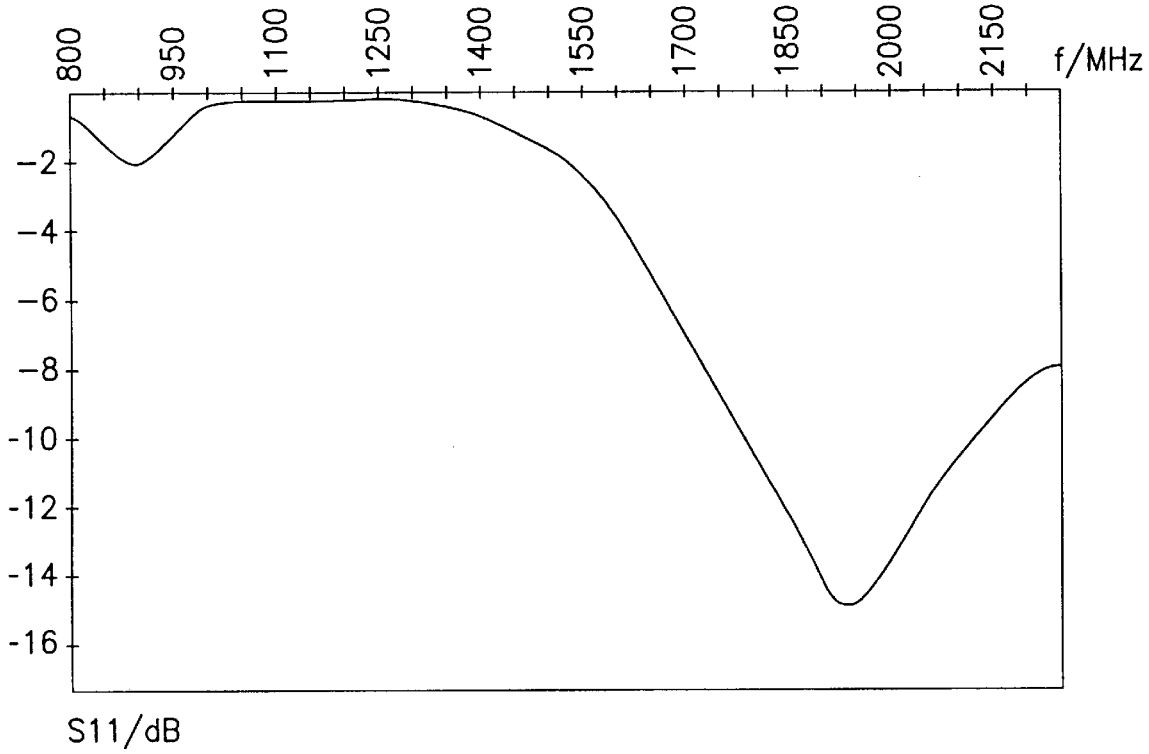
FIG. 3 presents graphically the behaviour of a calculated S-parameter $S_1$ of the antenna according to the embodiment of FIG. 2 as the function of frequency.

FIG. 4 presents another embodiment of the antenna structure according to the invention in which both helical element HX4 and rod element P3 have their respective feed points. Feed point A5 of the rod element is preferably placed on the symmetry axis of the structure because then rod element P3 does not have to be bent. Feed point A6 of the helical element is preferably placed so that the helix wire is bent, with respect to the operating position presented in the figure, from the periphery of the lowest turn directly towards ground plane GND, and feed point A6 is formed at the point where the helix wire meets the ground plane. In this embodiment it is especially easy to build a separate optimized matching circuit (not shown in the figure) for both antenna elements.

Figure 6:
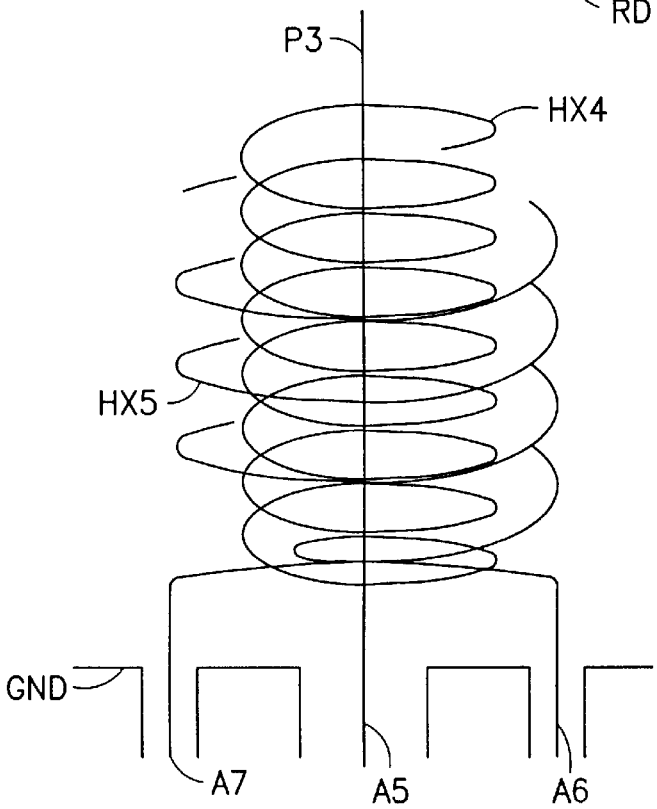
FIG. 6 presents schematically a third antenna structure according to the invention

If an antenna comprising three resonance frequency ranges is to be manufactured to be used in mobile phones of, e.g., the GSM frequency range (900 MHz), the higher JDC frequency range (1500 MHz), or the PCS frequency range (1900 MHz), a third antenna element can be added to the above-described antenna structures according to the invention, which is preferably a cylindrical coil conductor, i.e., helix HX5. Its inner diameter is preferably wider than the outer diameter of the first helical element HX4, whereby it fits around the smaller helical element according to FIG. 6. In the antenna with three antenna elements the feed points can be the same, or each antenna element P3, HX4, HX5 can comprise a respective feed point A5, A6, A7, as shown in FIG. 6. The diameter of the third antenna element can also be of essentially the same size as the first helical element, whereby the helical elements are placed sequentially in the direction of the longitudinal axis of the structure, or they are interwound.

The conducting parts of the antenna structure according to the invention, i.e., rod element P2; P3, and helical element HX3; HX4; HX5 can preferably be manufactured of stainless steel wire, phosphorus bronze wire, beryllium copper wire, or some other known conducting material. The rod element is cut from a straight wire to a suitable length, and if it comprises part P2*b* which is essentially outside helical element HX3; HX4; HX5, this part can be bent to save space. The helical element(s) is (are) preferably manufactured by winding. In order to improve the conductive properties, the rod or helical elements or both of them can be plated with gold, silver, or some other material which conducts particularly well. When the antenna according to the invention is placed in the mobile phone, the ground plane which is marked with reference GND in the figures, is the ground plane of the telephone.

Figure 5:
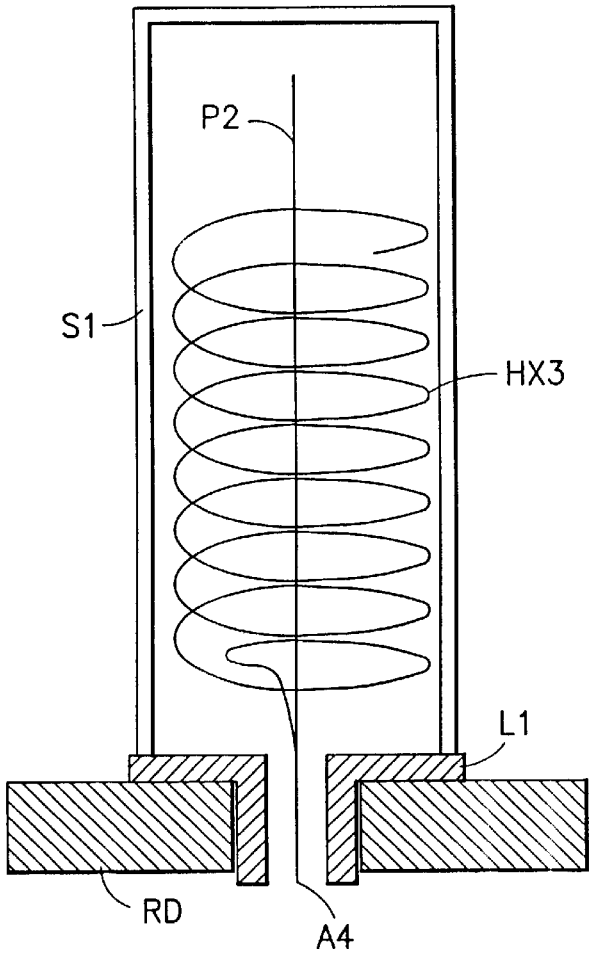
FIG. 5 is a cross-section of an embodiment of the antenna structure according to the invention.

The usability of the antenna structure according to the invention as a mobile phone antenna can be improved by coating it with protective dielectric coating S1 according to FIG. 5, in the same way as mobile phone antennas of prior art are coated, excluding feed point A4 and possibly connecting part L1 which connects the antenna structure to body RD of the radio set. Protective coating S1 is preferably of some known elastic material which is well-adapted to the mass production of antennas, such as injection-moulded plastic or a rubber mixture. If rod element P2, P3 is essentially longer than helical element HX3, HX4, HX5 in the direction of the longitudinal axis of the antenna structure, it can be provided with a telescopic structure in a similar way as in solutions according to prior art. This provides the advantage that in areas where data communication systems based on the resonance frequency of helical element HX3, HX4, HX5 are the only systems used, the outer dimensions of radio sets using antennas according to the invention can be made smaller. In this case the rod element does not disturb the operation of the helical element as an antenna even to the extent where the rod element is inside the helical element. The entire antenna structure can also be provided with a sliding mechanism through which it can be partly pushed inside and pulled out of the shell of the mobile phone to save space when needed.

The antenna structure according to the invention can be applied to radio communications where two different frequency ranges are used, preferably on radio frequencies such as UHF and VHF. The resonance frequencies only depend on the dimensions of the different parts of the antenna, so they can be selected relatively freely during the designing and manufacturing stages. Since the antenna structure according to the invention comprises, in the preferred embodiment thereof, only two parts and a possible connecting part for attaching it to the radio set, and a possible protective cover, its structure is very simple and it is very well-adapted to mass production. Placing the antenna elements inside one another makes the structure small compared to, e.g., the structure presented in U.S. Pat. No. 4,442,438 and handled above in connection with prior art, whereby it is very well suited to modern, small mobile phones.

What is claimed is:

1. An antenna for transmitting and receiving radio frequency oscillations by using a radio transceiver, said antenna comprising:

a first antenna element which has a first input impedance and a first resonance frequency; and a second antenna element which is a cylindrical coil conductor and has a second input impedance and a second resonance frequency that is different than said first resonance frequency, wherein a part of said first antenna element is located inside said cylindrical coil conductor, and wherein the first and second antenna elements provide two respective different, separate and spaced operating frequency ranges, wherein the two different operating frequency ranges are separated from each other by at least about 400 MHz.

2. An antenna according to claim 1, characterized in that said first antenna element (P2; P3) is a straight conductor.

3. An antenna according to claim 1, characterized in that the feed point (A4) of said first antenna element is the same as the feed point (A4) of said second antenna element.

4. An antenna according to claim 1, characterized in that the feed point (A5) of said first antenna element is not the same as the feed point (A6) of said second antenna element.

5. An antenna according to claim 4, characterized in that the feed point (A5) of said first antenna element is essentially on its longitudinal axis, and the feed point (A6) of said second antenna element is essentially on its cylindrical envelope.

6. An antenna according to claim 1, characterized in that it further comprises a third antenna element (HX5) whose resonance frequency is different to the resonance frequency of said first antenna element (P2; P3) and different to the resonance frequency of said second antenna element (HX3; HX4).

7. An antenna according to claim 6, characterized in that said third antenna element (HX5) is a cylindrical coil conductor.

8. An antenna according to claim 1, characterized in that it comprises a connecting part (L1) for connecting it mechanically and electrically to the radio set.

9. An antenna according to claim 1, characterized in that it comprises a protective cover (S1) of a dielectric material for protecting the said antenna elements (P2; P3; HX3; HX4; HX5).

10. An antenna according to claim 1, characterized in that at least one antenna element (P2; P3; HX3; HX4; HX5) is retractable within said radio set.

11. A radio telephone antenna assembly comprising:

a first antenna having a rod antenna element; and a second antenna having a helical antenna element;

wherein the rod antenna element has a different resonance frequency than a resonance frequency of the helical antenna element, wherein the two resonance frequencies are spaced from each other;

wherein the rod antenna element extends along a center axis of the helical antenna element along the entire height of the helical antenna element;

wherein the first and second antennas are adapted to separately communicate with different types of radio telephone systems having different operating frequency ranges which are spaced from each other, wherein the different operating frequency ranges are spaced from each other by at least about 400 MHz, and wherein there is no significant alteration in a radiation pattern of the rod antenna element by the helical antenna element and there is no considerable change in a radiation pattern of the helical antenna element by the rod antenna element.

12. A method of communicating by a radio telephone with two different types of radio telephone systems having different operating frequency ranges, the method comprising steps of:

providing the radio telephone with an antenna assembly having a rod antenna element and a helical antenna element, the rod antenna element having a different resonance frequency than a resonance frequency of the helical antenna element, wherein the two resonance frequencies are spaced from each other by at least about 400 MHz, the rod antenna element extending along a center axis inside of the helical antenna element, and both the rod antenna element and helical antenna element are always electrically connected to at least one feed point for the antenna assembly; and transmitting and receiving radio frequency signals at the rod antenna element with the first one of the different types of radio telephone systems;

wherein there is no considerable change in radiation patterns of the rod antenna element and the helical antenna element, due to their relative positioning, even though both antenna elements are always electrically connected to the same at least one feed point.

* * * * *